US008092053B1

(12) United States Patent
Kopp

(10) Patent No.: US 8,092,053 B1
(45) Date of Patent: Jan. 10, 2012

(54) LIGHT FIXTURE ASSEMBLY AND METHOD OF MANUFACTURE

(76) Inventor: Harold Phillip Kopp, Gilbert, AZ (US)

( * ) Notice: Subject to any disclaimer, the term of this patent is extended or adjusted under 35 U.S.C. 154(b) by 0 days.

(21) Appl. No.: 12/779,429

(22) Filed: May 13, 2010

Related U.S. Application Data

(60) Provisional application No. 61/271,322, filed on Jul. 20, 2009.

(51) Int. Cl.
*F21V 7/00* (2006.01)

(52) U.S. Cl. ..... 362/311.02; 362/219

(58) Field of Classification Search ..... 362/219, 362/223, 225, 217.1, 311.02, 311.14, 311.15, 362/367; 40/431
See application file for complete search history.

(56) References Cited

U.S. PATENT DOCUMENTS

| | | | | |
|---|---|---|---|---|
| 4,570,207 | A | 2/1986 | Takahashi et al. | |
| 5,984,570 | A | 11/1999 | Parashar | |
| 6,082,886 | A | 7/2000 | Stanford | |
| 6,092,909 | A | 7/2000 | Sools et al. | |
| 6,116,751 | A | 9/2000 | Remp | |
| 6,602,021 | B1 | 8/2003 | Kim | |
| 6,655,814 | B1 | 12/2003 | Tagawa et al. | |
| 6,727,643 | B2 * | 4/2004 | Suehiro | 313/499 |
| 7,021,786 | B1 * | 4/2006 | Sandor, Sr. | 362/153 |
| 2003/0090896 | A1 | 5/2003 | Sooferian | |
| 2003/0137831 | A1 | 7/2003 | Lin | |
| 2003/0151361 | A1 * | 8/2003 | Ishizaka | 313/512 |
| 2004/0070990 | A1 * | 4/2004 | Szypszak | 362/555 |
| 2004/0223327 | A1 * | 11/2004 | Kuan et al. | 362/249 |
| 2005/0199282 | A1 | 9/2005 | Oleinick et al. | |
| 2006/0002101 | A1 * | 1/2006 | Wheatley et al. | 362/84 |
| 2006/0291196 | A1 | 12/2006 | Benavente | |
| 2007/0047238 | A1 * | 3/2007 | Vukosic et al. | 362/368 |
| 2008/0101084 | A1 * | 5/2008 | Hsu | 362/612 |

* cited by examiner

*Primary Examiner* — Julie Shallenberger
(74) *Attorney, Agent, or Firm* — Parsons & Goltry; Michael W. Goltry; Robert A. Parsons

(57) ABSTRACT

A light fixture assembly includes a light-transmissive fixture. The light-transmissive fixture has a surface, and a light-emitting diode (LED) assembly is applied to the surface to illuminate the light-transmissive fixture. An encasement is applied to the surface of the light-transmissive fixture encasing the LED assembly to substantially isolate the LED assembly from environmental influences.

12 Claims, 14 Drawing Sheets

FIG. 13
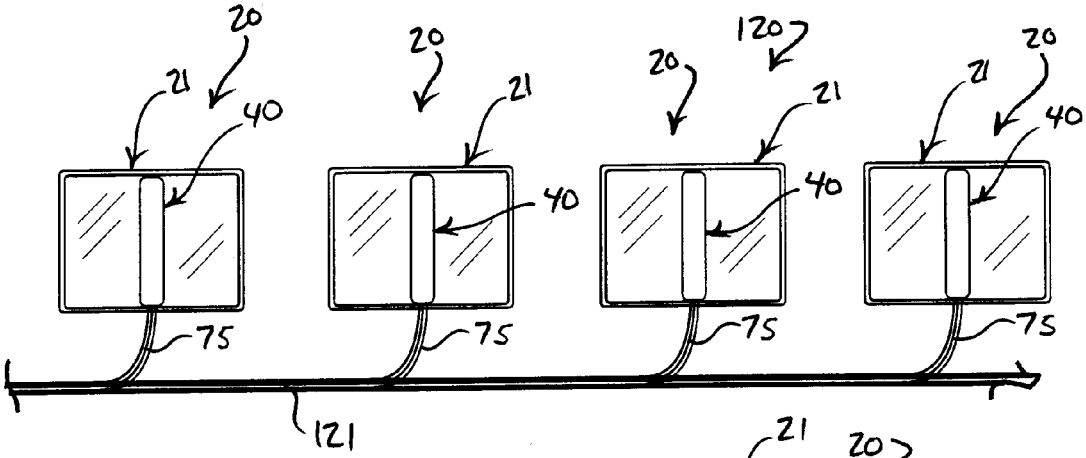
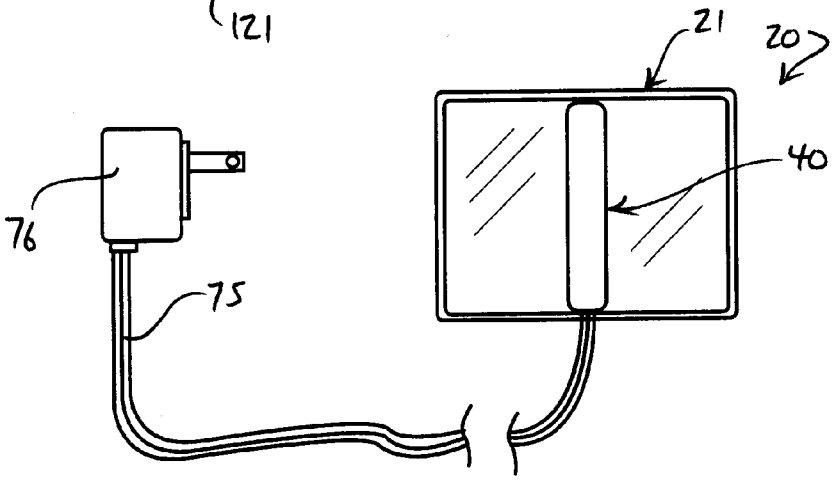
FIG. 12

LIGHT FIXTURE ASSEMBLY AND METHOD OF MANUFACTURE

CROSS-REFERENCE TO RELATED APPLICATION

This application claims the benefit of U.S. Provisional Patent Application Ser. No. 61/271,322, filed Jul. 20, 2009.

FIELD OF THE INVENTION

The present invention relates to lights and to light fixtures.

BACKGROUND OF THE INVENTION

Lighting or illumination is the application of light to achieve an aesthetic or practical effect. Lighting can include the use of both natural light, and artificial light provided by artificial light sources, such as lamps and light fixtures. Artificial lighting is most commonly provided today by electric lights.

There are a wide variety of electric lights. Some electric lights are designed for use indoor settings, while other forms of electric lights are designed for use in outdoor settings, such as in landscaping. Electric lights for use in outdoor settings, such as in landscaping, are typically engineered to withstand environmental influences, such as moisture, water, debris, and the like. Because outdoor electric lights must be engineered to withstand environmental influences, they are often expensive and difficult to engineer and construct. Accordingly, what is needed is a light fixture assembly that equally useful in indoor and outdoor settings that is inexpensive, easy to construct, rugged, and useful in a wide variety of lighting applications.

SUMMARY OF THE INVENTION

According to the principle of the invention, a light fixture assembly includes a light-transmissive fixture having a surface, a light-emitting diode (LED) assembly applied to the surface of the light-transmissive fixture to illuminate the light-transmissive fixture, and an encasement applied to the surface of the light-transmissive fixture encasing the LED assembly to substantially isolate the LED assembly from environmental influences. The surface of the light-transmissive fixture is an exterior surface. The LED assembly is electrically connected to a power cord to transmit electrical power to the LED assembly. The LED assembly includes a plurality of light-emitting diodes (LEDs) affixed to the exterior surface of the light-transmissive fixture. The LEDs are preferably electrically connected. The encasement preferably includes a mass of hardened epoxy, and the light fixture is preferably a glass block.

According to the principle of the invention, a light fixture assembly includes a light-transmissive fixture having a surface, a shell applied to the surface, and a volume formed between the shell and the surface of the light-transmissive fixture. The volume formed between the shell and the surface of the light-transmissive fixture is filled with a mass of hardened material, which is applied to the surface of the light-transmissive fixture. A light-emitting diode (LED) assembly is located in the volume, is formed in the mass of hardened material, and is to illuminate the light-transmissive fixture. The mass of hardened material substantially isolates the LED assembly from environmental influences. The surface of the light-transmissive fixture is an exterior surface. The LED assembly is electrically connected to a power cord to transmit electrical power to the LED assembly. The LED assembly includes a plurality of light-emitting diodes (LEDs), mechanically carried by a circuit board assembly, affixed to the exterior surface of the light-transmissive fixture. The circuit board assembly electrically connects the LEDs. The circuit board assembly is located in the volume and is embedded in the mass of hardened material. The mass of hardened material substantially isolates the circuit board assembly from environmental influences. The mass of hardened material is preferably a mass of hardened epoxy.

According to the principle of the invention, a light fixture assembly includes a glass block having an outer surface and an inner surface bounding an enclosed, interior volume. A shell is affixed to the outer surface of the glass block. A volume is formed between the shell and the outer surface of the glass block. A mass of hardened material is applied to the volume, and preferably fills the volume. The mass of hardened material is applied against and is adhered to the outer surface of the glass block. Light-emitting diodes (LEDs) are located in the volume and are embedded in the mass of hardened material. The mass of hardened material substantially isolates the LEDs from environmental influences, and the LEDs are directed toward the outer surface of the glass block to illuminate the glass block. The LEDs are electrically connected, preferably with a circuit board assembly attached to the LEDs. The circuit board assembly is electrically connected to a power cord to transmit electrical power to the LEDs. The circuit board assembly is located in the volume and embedded in the mass of hardened material, and the mass of hardened material substantially isolates the circuit board assembly from environmental influences. The mass of hardened material is preferably a mass of hardened epoxy.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings:

FIG. 12 is a highly generalized view of the light fixture assembly of FIG. 1 illustrating a plug formed in a power cord of the light fixture assembly;

FIG. 13 is a highly generalized schematic representation of electrical wiring electrically coupling a plurality of light fixture assemblies each constructed and arranged in accordance with the principle of the invention;

DETAILED DESCRIPTION

Figure 1:
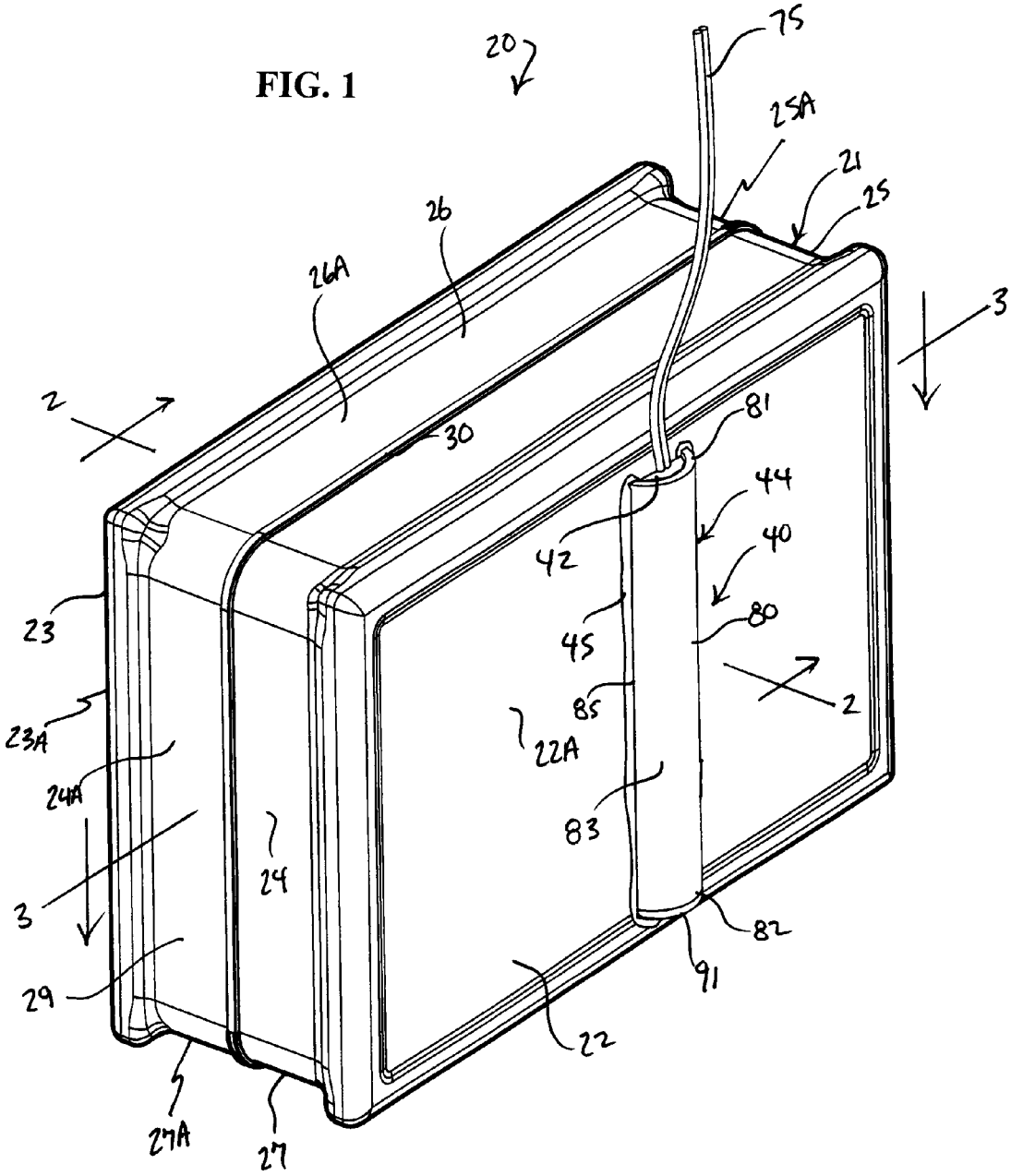
FIG. 1 is a perspective view of a light fixture assembly constructed and arranged in accordance with the principle of the invention.

Turning now to the drawings, in which like reference characters indicate corresponding elements throughout the several views, attention is first directed to FIG. 1 in which there is seen a light fixture assembly 20 including a glass block 21 and an attached light assembly 40 to illuminate glass block 21, in accordance with the principle of the invention. Glass block 21 is conventionally structured and is a fixture that consists of a rectangular, translucent block made of glass having a front wall 22 oppositely disposed from a back wall 23, two oppositely disposed sidewalls 24 and 25, and a top wall 26 oppositely disposed from a bottom wall 27. Front and back walls 22 and 23 are the major walls of glass block 21, and sidewalls 24 and 25 and top and bottom walls 26 and 27 are the minor walls of glass block 21.

Front wall 22 has an exterior surface 22A and an opposed interior surface 22B, back wall 23 has an exterior surface 23A and an opposed interior surface 23B, sidewall 24 has an exterior surface 24A and an opposed interior surface 24B, sidewall 25 has an exterior surface 25A and an opposed interior surface 25B, top wall 26 has an exterior surface 26A and an opposed interior surface 26B, and bottom wall 27 has an exterior surface 27A and an opposed interior surface 27B. Interior surfaces 22B, 23B, 24B, 25B, 26B, and 27B of the respective walls cooperate to define a hollow sealed interior chamber or volume 28. Front and back walls 22 and 23 each normally extend outward beyond sidewalls 24 and 25 and top and bottom walls 26 and 27 so as to provide a slight recess 29 encircling block 21. As a matter of example, recess 29 allows placement of block 21 in wet mortar, wherein the mortar fills recess 29, and when the mortar hardens, block 21 is essentially locked in place. Exterior surfaces 22B and 23B of front and back walls 22 and 23, respectively, are flat in the present embodiment, and may, if desired, be irregular to distort viewing through glass block 21. Glass block 21 is normally originally created in two separate halves which are permanently sealed together along a peripheral seam 30, which is centrally positioned in sidewalls 24 and 25 and top and bottom walls 26 and 27.

Glass block 21 is a well-known glass block, which is an architectural element that admits light providing a light-transmissive characteristic. As glass block 21 admits light and is light-transmissive, glass block 21 is exemplary of a light-transmissive fixture. Given that glass block 21 is well-known and entirely conventional, further details of glass block 21 will readily occur to the skilled artisan and will not be discussed in further detail. Glass block 21 may be of any selected size, such as approximately 4"×8"×3", 12"×12"×4", etc.

According to the principle of the invention, a light assembly 40 is secured to glass block 21 to illuminate glass block 21. Looking to FIGS. 2 and 3, light assembly 40 includes a light component assembly 41 that is applied to exterior surface 22A of front wall 22 of glass block 21 to illuminate glass block 21 from this attached position by directing light into and through glass block 21 from exterior surface 22A of glass block 21. Light component assembly 41 is embedded in a mass of hardened material denoted at 42, which is applied to and maintained by a volume 43 bound by a shell 44 secured to exterior surface 22A of front wall 22 of glass block 21 adhesive 45 applied between shell 44 and exterior surface 22A of front wall 22 of glass block 21. Mass of hardened material denoted at 42 into which light component assembly 41 is embedded is an encasement applied to exterior surface 22A of front wall 22 of glass block 21, which substantially encases and substantially isolates light component assembly 41 from environmental influences, namely, from direct exposure to moisture, water, chemicals, debris, and the like, to ensure the continued and reliable operation of light component assembly 41. Shell 44 forms part of the encasement.

Figure 6:
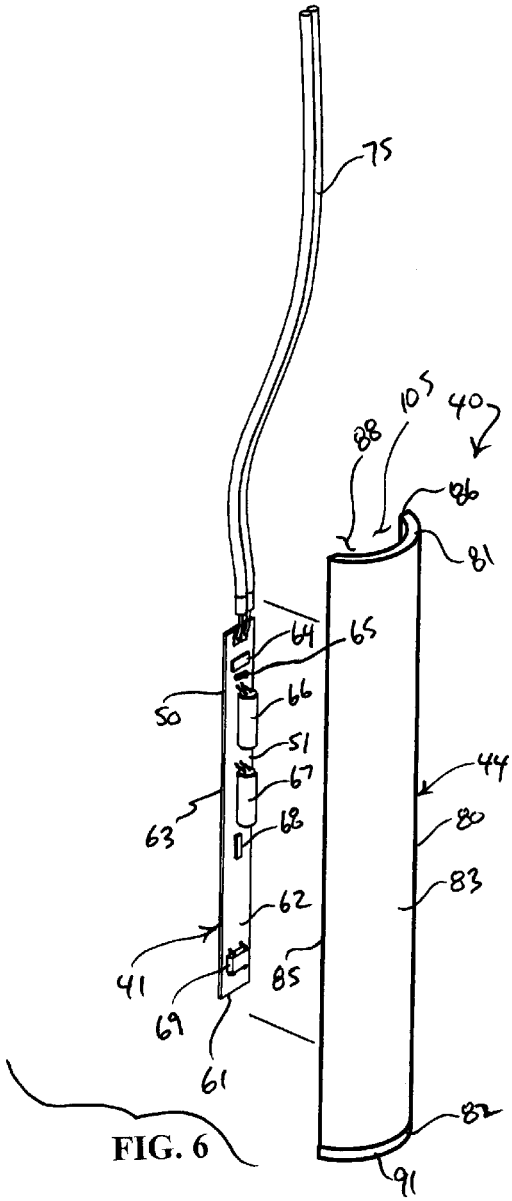
FIGS. 6 and 7 are perspective views of the light component assembly and the shell of FIG. 4.
Figure 7:
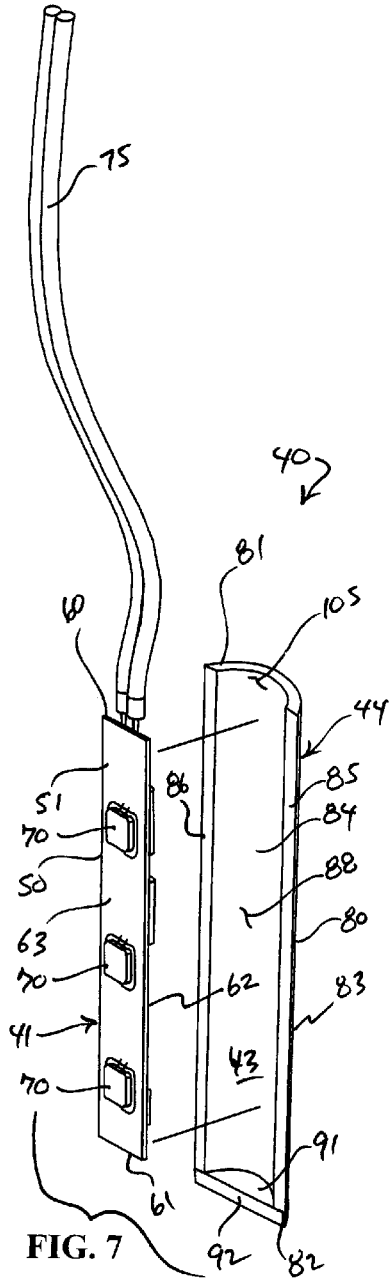

Referencing FIGS. 6 and 7 in relevant part, light component assembly 41 consists of a circuit board assembly denoted generally at 50 that includes a printed circuit board 51. Printed circuit board 51 is conventionally structured, and mechanically supports and electrically connects electronic components of light component assembly 41 using conductive pathways or tracks or traces etched from copper sheets laminated onto a dielectric or non-conductive substrate.

Printed circuit board 51 has opposed proximal and distal ends 60 and 61, and opposed upper and lower surfaces 62 and 63 extending therebetween. Printed circuit board 51 is elongate and narrow in shape, and has a length extending from proximal end 60 to distal end 61. Printed circuit board 51 mechanically supports electronic components on upper surface 62 consisting of a conventional array of capacitors and resistors, and mechanically supports light-emitting diodes (LEDs) 70 on lower surface 63. In the present embodiment, the electronic components on upper surface 62 consist of voltage regulator 64, C4 capacitor 65, C3 capacitor 66, C1 capacitor 67, R1 resistor 68, and DB1 bridge rectifier 69. As seen in FIG. 7, LEDs 70 are positioned at spaced intervals along the length of printed circuit board 51 between proximal end 60 and distal end 61. In the present embodiment, light assembly 40 incorporates three LEDs 70, and less or more can be used. LEDs 70 constitute the light source of light assembly 40 that illuminates glass block 21, and are preferably conventionally structured full-spectrum LEDs. In alternate embodiments, LEDs 70 may be limited spectrum LEDs to provide a selected wavelength/color of visible light, such as red light, blue light, yellow light, etc., in order to provide a desired lighting effect. LEDs 70 may each give of the same color of light, or different colors of light as my be desired. LEDs 70 are preferred in light fixture assembly 21 as they have a long life, are not prone to failure, and are low power usage light components. LEDs are electrically connected with printed circuit board 51, which is, in turn, electrically connected to a power cord 75. Power cord 75 is conventionally structured, is a form of electrical wiring, and is electrically connected to printed circuit board 51 at proximal end 60. Power cord 75 is, in turn, electrically connected to a conventionally structured electrical plug 76, shown in FIG. 12, which is configured to be plugged into a conventional outlet to transmit electrical power to the LEDs 70 via printed circuit board 51 and the electrical components applied to upper surface 62 of printed circuit board 51 to activate and thus illuminate LEDs 70. If desired, power cord may be powered by a step down low voltage transformer electrically isolated from an electrical power supply. Cord 75 is preferably associated with a low-voltage electrical buss wire which carries low voltage to power cord 75. Light component assembly 41 is exemplary of a LED light component assembly.

With continuing reference to FIGS. 6 and 7, shell 44 is a hard, outer cover of the encasement encasing light component assembly 41. Shell 44 is formed of plastic, polyvinyl chloride material, or other strong, impact resistant, substantially rigid material or combination of materials, and consists of an elongate shell wall 80 having a proximal end 81 and an opposite distal end 82, an outer surface 83 and an opposed inner surface 84. Wall 80 arches upwardly from opposed, substantially parallel edges 85 and 86 that extend between proximal and distal ends 81 and 82, in which outer surface 83 is substantially convex or substantially outwardly curved and inner surface 84 is substantially concave or substantially inwardly curved. A gap 88 is formed between edges 85 and 86 that leads to volume 43, and gap 88 extends from proximal end 81 to distal end 82. Volume 43 is, in turn, bound and defined by inner surface 84 of wall 80 extending between edges 85 and 86 defining gap 88, and extends along the length of wall 80 from proximal end 81 of wall 80 to distal end 82 of wall 80. Proximal end 81 is open as illustrated leading to volume 43, and distal end 82 is closed with an attached cap 91 closing volume 43 at distal end 82. Cap 91 is secured in place to distal end 82 with adhesive, welding or the like. If desired, cap 91 can be integrally formed with distal end 82 of shell wall 80. As seen in FIG. 7, cap 91 has a lower edge 92 that meets edges 85 and 86 at distal end 82 of wall. The overall length of volume 43 of shell 44 extending between proximate end 81 of wall 80 and cap 91 formed at distal end 82 of wall 80 is somewhat greater than the overall length of light component assembly 41 extending between proximal and distal ends 60 and 61 of light component assembly 41.

Figure 2:
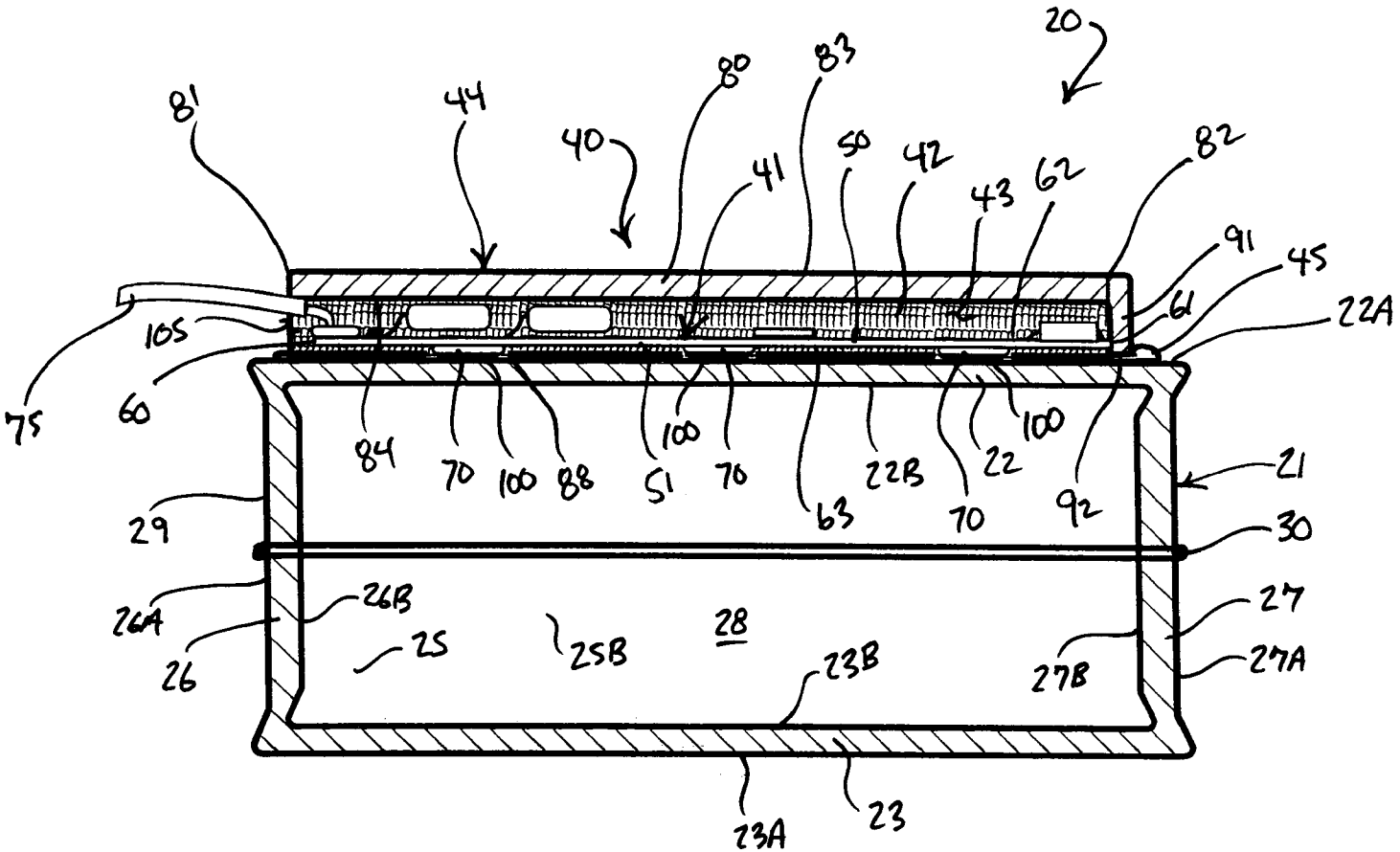
FIG. 2 is a section view taken along line 2-2 of FIG. 1.

Referencing FIG. 2, light component assembly 41 is affixed to exterior surface 22A of front wall 22 of glass block 21 directing LEDs 70 toward exterior surface 22A of front wall 22 of glass block 21 to allow LEDs to illuminate glass block 21 when activated. In a preferred embodiment, light component assembly 41 is affixed to exterior surface 22A of front wall 22 of glass block with adhesive 100 applied between each LED 70 and exterior surface 22A of front wall 22 of glass block. Preferably, the length of light component assembly 41 from proximal end 60 to distal end 61 is substantially parallel with respect to sidewalls 24 and 25 of glass block 21, and is substantially perpendicular with respect to top and bottom walls 26 and 27 of glass block. The length of light component assembly 41 from proximal end 60 to distal end 62 extends along exterior surface 22A of front wall 22 of glass block 21 between top and bottom walls 26 and 27 of glass block, in which proximal end 60 of light component assembly 41 is directed toward and is located just inboard of top wall 26 of glass block 21, and distal end 61 of light component assembly 41 is directed toward and is located just inboard of bottom wall 27 of glass block 21. In this orientation of light component assembly 41, power cord 75 electrically connected to distal end 60 of light component assembly 41 projects outwardly and away from top wall 26 of glass block 21.

Figure 3:
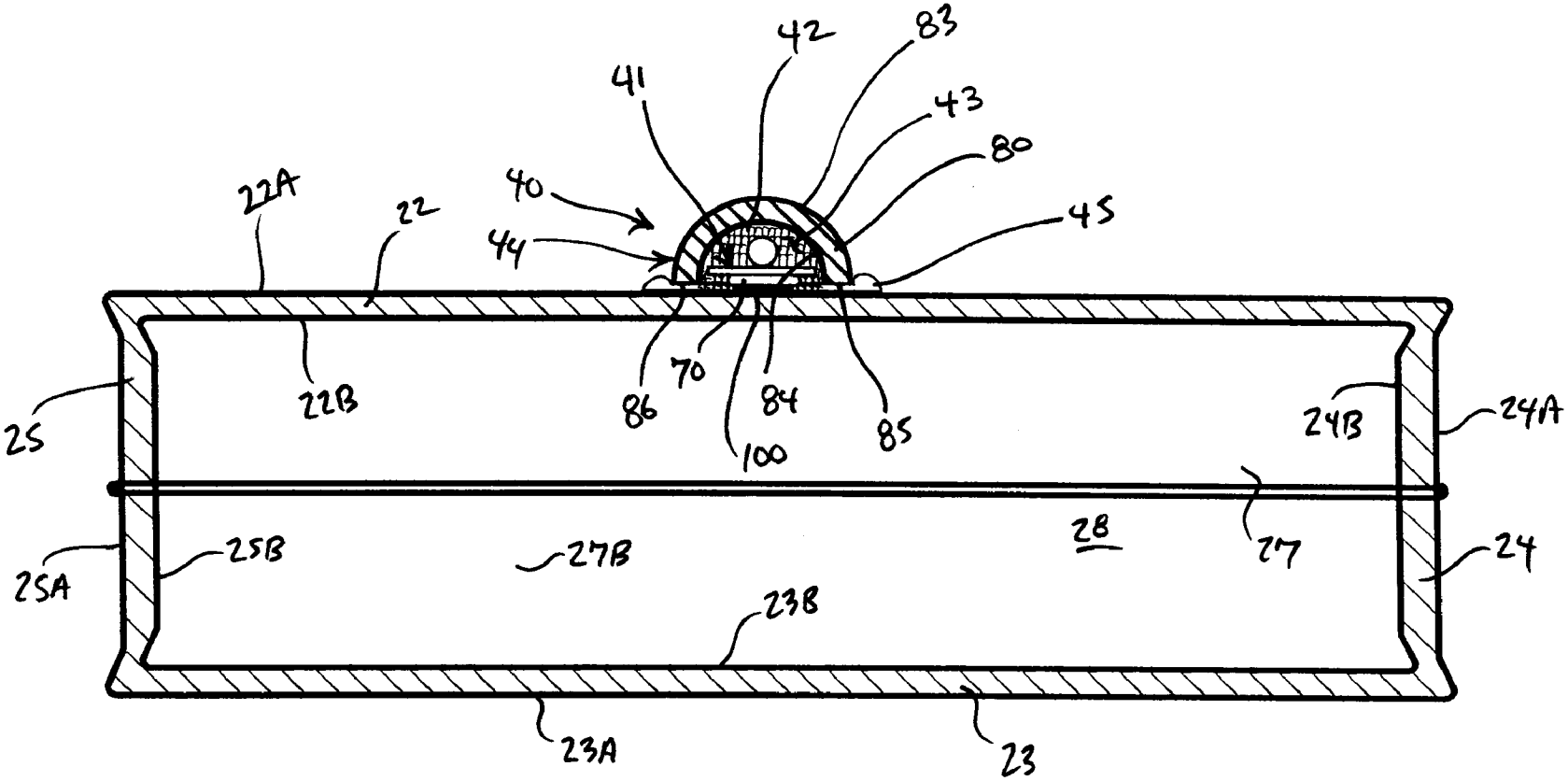
FIG. 3 is a section view taken along line 3-3 of FIG. 1.

Shell 44 is applied over light component assembly 41 locating light component assembly 41 in volume 43, and is affixed in place to exterior surface 22A of front wall 22 of glass block 21. Edges 84 and 85 of shell 44 are applied on, and extend along, either side of light component assembly 41 as seen in FIG. 3 and extend along the length of light component assembly 41 from proximal end 81 of shell at proximal end 60 of light component assembly 41 to distal end 82 of shell 44 at distal end 61 of light component assembly 41. Lower edge 92 of cap 91 of shell 44 extends across proximal end 61 of light component assembly 41 as shown in FIG. 2. Shell 44 is affixed to exterior surface 22A of front wall 22 of glass block 21 with a band of adhesive 45 applied between edges 84 of shell 44 as shown in FIG. 3 and lower edge 92 of cap 91 of shell 44 as shown in FIG. 2. Volume 43 of shell 44 extends between proximal end 81 of shell 44 and distal end 82 of shell 44 and is defined between inner surface 84 of wall 80 of shell 44 and exterior surface 22A of front wall 22 of glass block 21.

Light component assembly 41 extends into volume 43 through gap 88 formed between edges 84 and 85 of shell 44 affixed to exterior surface 22A of front wall 22 of glass block 21 with band of adhesive 45. Light component assembly 41 extends substantially centrally into and through volume 43 from proximal end 60 of light component assembly 41 located in volume 43 just inboard of proximal end 81 of shell 44, to distal end 61 directed toward cap 91 at distal end 82 of shell 44. Because the length of light component assembly 41 extending between proximal end 60 to distal end 61 is substantially parallel with respect to sidewalls 24 and 25, and is substantially perpendicular with respect to top and bottom walls 26 and 27, the length of shell 44 extending from proximal end 81 to distal end 82 is, in turn, substantially parallel with respect to sidewalls 24 and 25, and is substantially perpendicular with respect to top and bottom walls 26 and 27. As seen in FIG. 2, the length of shell 44 from proximal end 81 to distal end 82 extends along exterior surface 22A of front wall 22 of glass block 21 between top and bottom walls 26 and 27, in which proximal end 81 is directed toward and is located just inboard of top wall 26, and distal end 82 is directed toward and is located just inboard of bottom wall 27. Cap 91 applied to distal end 82 of shell 44 forms a closed end of volume 43 formed between exterior surface 22A of front wall 22 of glass block and inner surface of shell wall 80, and proximal end 81 of shell wall 80 is left open to define an open end 105 of shell 44 between distal end 81 of shell 44 and exterior surface 22A of front wall 22 of glass block 21, which is an opening to volume 43 at proximal end 81 of shell 44.

Hardened material 42 is applied to volume 43 between shell 44 and exterior surface 22A of front wall 22 of glass block 21, fills volume 43 from open end 105 at proximal end 81 of shell 44 to cap 91 at distal end of shell 44, and encapsulates light component assembly 41 from proximal end 60 to distal end 61, and between LEDs 70 affixed to exterior surface 22A of front wall 22 of glass block 21 and inner surface 84 of wall 80 of shell 44. Mass of hardened material 42 applied to volume 43 formed between shell 44 and exterior surface 22A of front wall 22 of glass block 21 adheres to exterior surface 22A. Because light component assembly 41 is encapsulated in mass of hardened material 42 or otherwise embedded into mass of hardened material 42, mass of hardened material 42 substantially isolates light component assembly 41 from environmental influences, namely, from direct exposure to moisture, water, chemicals, debris, and the like to ensure the continued and reliable operation of light component assembly 41

Figure 4:
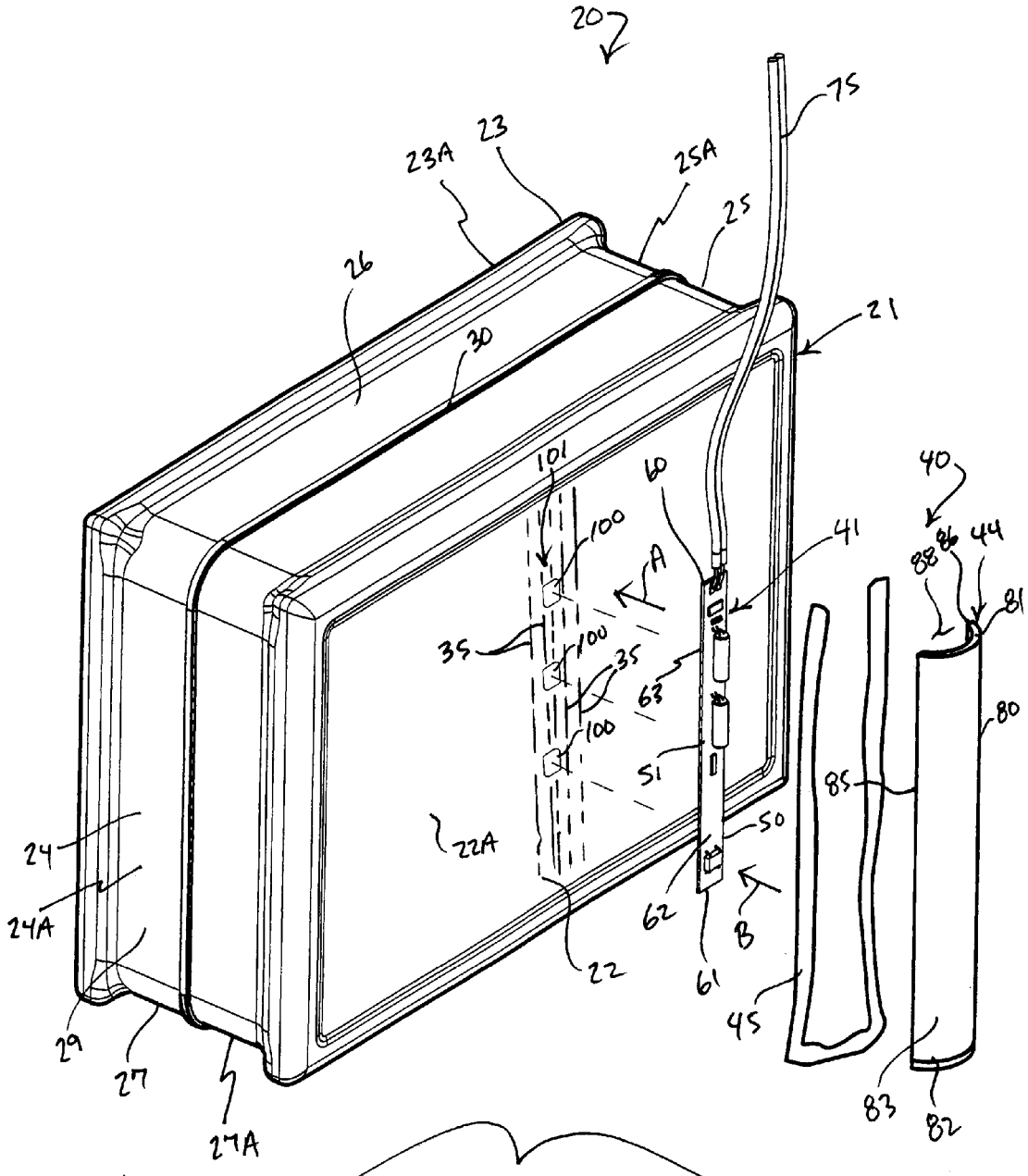
FIG. 4 is an exploded perspective view illustrating components of the light fixture assembly of FIG. 1 in the manufacture of the light fixture assembly, the components consisting of a light-transmissive fixture, a light component assembly to be applied to the light-transmissive fixture, a shell, and a band of adhesive to attach the shell to the light-transmissive fixture.
Figure 5:
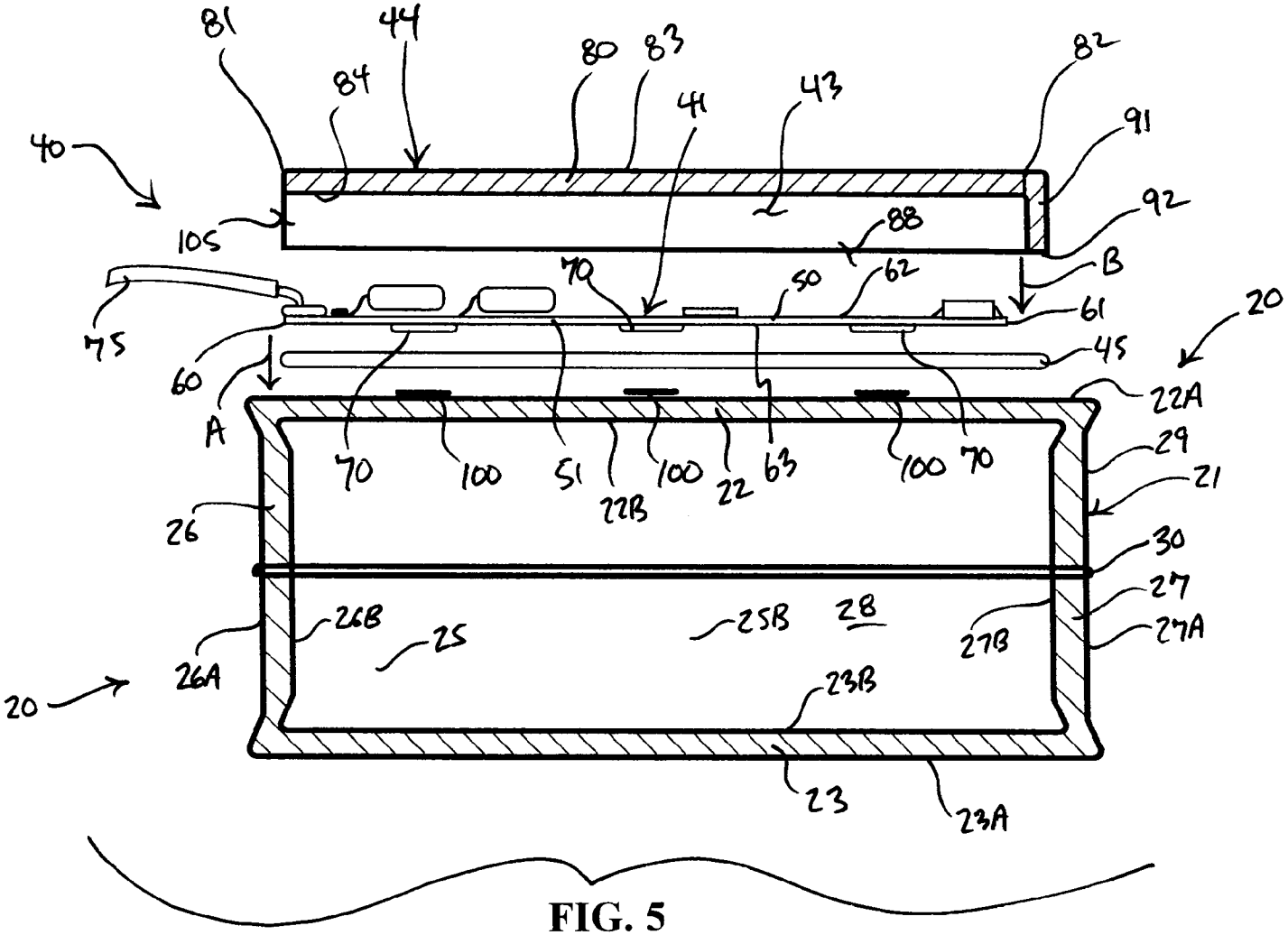
FIG. 5 is partial vertical section view of the embodiment of FIG. 4.

To construct light fixture assembly 20, and with reference to FIGS. 4 and 5, light component assembly 41 is affixed to exterior surface 22A of front wall 22 of glass block 21 directing LEDs 70 toward exterior surface 22A of front wall 22 of glass block 21 to allow LEDs to illuminate glass block 21 when activated from its attached location of exterior surface 22A of front wall 22 of glass block 21. In a preferred embodiment, light component assembly 41 is affixed to exterior surface 22A of front wall 22 of glass block with adhesive 100 applied between LEDs 70 and exterior surface 22A of front wall 22 of glass block. Application of adhesive 100 between LEDs 70 and exterior surface 22A of front wall 22 of glass block is carried out through the application of small dollops or spots of adhesive 100 applied between exterior surface 22A of front wall 22 of glass block 21 and LEDs 70, respectively, to adhesively secure LEDs 70 to exterior surface 22A of front wall of glass block 21 to, in turn, adhesively secure light component assembly 41 to exterior surface 22A of front wall 22 of glass block 21.

And so the adhesive applied between LEDs 70 and exterior surface 22A of front wall 22 of glass block 21 is provided in the form of spots of adhesive 100 applied to exterior surface 22A of front wall of glass block 21 as shown in FIGS. 4 and 5. Spots of adhesive 110 are applied at spaced intervals along exterior surface 22A of front wall 22 of glass block 21. Spots of adhesive 100 are positioned to relate to LEDs 70, respectively, and are positioned to form a row denoted generally at 101 that is located at a substantially central location of exterior surface 22A of front wall 22 of glass block 21. Referencing FIG. 4, row 101 of spots of adhesive 100 is substantially parallel with respect to sidewalls 24 and 25, and is substantially perpendicular with respect to top and bottom walls 26 and 27.

Figure 9:
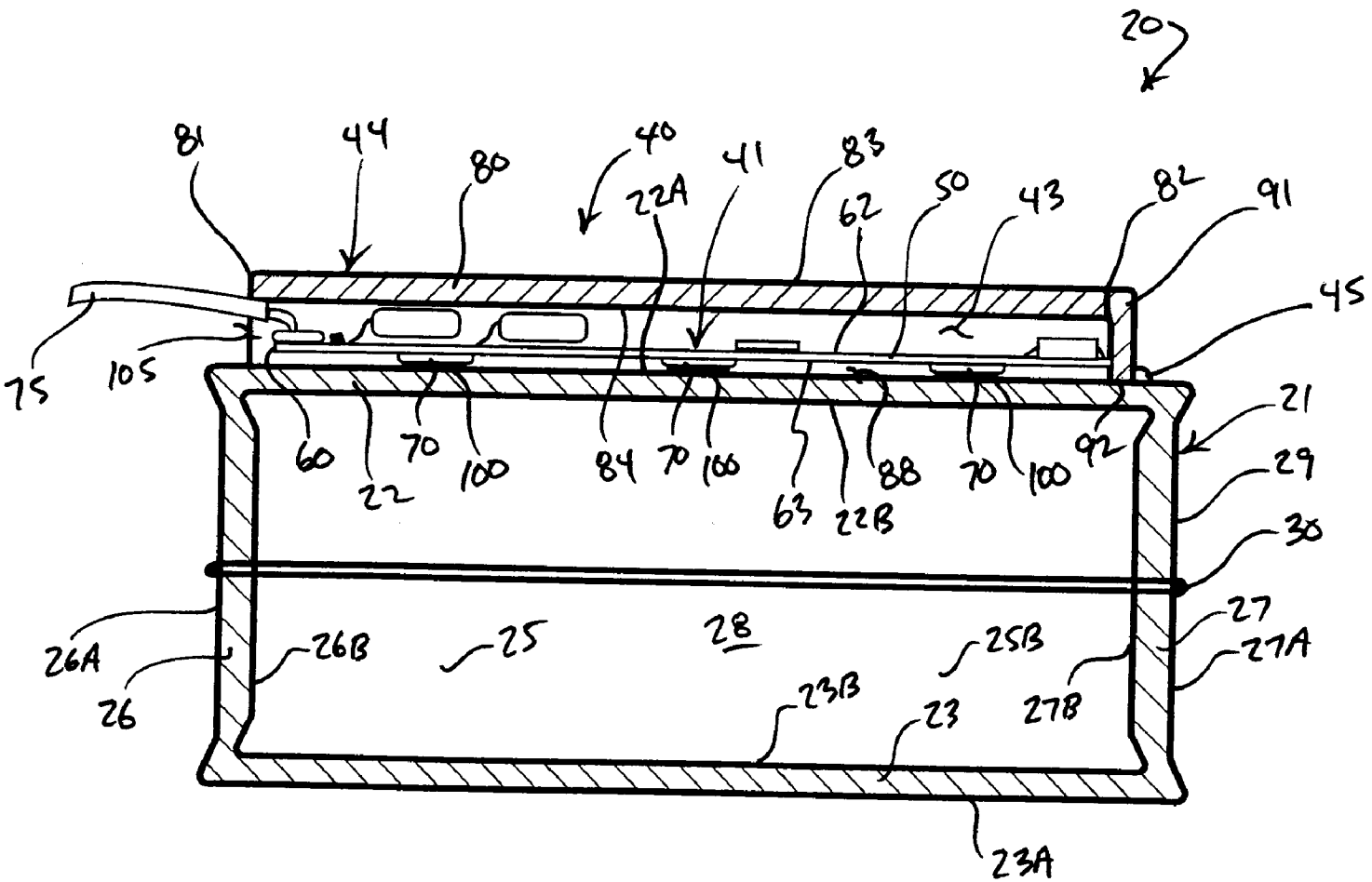
FIG. 9 is a section view taken along line 9-9 of FIG. 8 illustrating a volume formed between the shell and the surface of the light-transmissive fixture.

After spots of adhesive 100 are applied to exterior surface 22A of front wall 22 of glass block 21, light component assembly 41 is taken up, such as by hand, and positioned to substantially relate LEDs 70 with spots of adhesive 100. Light component assembly 41 is then moved toward exterior surface 22A of front wall 22 of glass block 21 in the direction indicated by the arrowed line A in FIGS. 4 and 5 applying each LED 70 to one of the spots of adhesive 100 as shown in FIG. 9. After LEDs 70 are applied to the respective spots of adhesive 100, spots of adhesive 100 are left to cure or harden during a waiting period sufficient to allow spots of adhesive 100 to harden or cure to adhesively bond LEDs 70, and thus light component assembly 41, to exterior surface 22A of front wall 22 of glass block 21. In a preferred embodiment, the adhesive forming spots of adhesive 100 is preferably a tenacious, fast-acting adhesive, such as a cyanoacrylate-based fast-acting adhesive, that hardens or otherwise cures in a relatively short period of time, such as from about 30-60 seconds upon application. Other like or similar tenacious adhesives can be used without departing from the invention. Because row 101 of spots of adhesive 100 is substantially parallel with respect to sidewalls 24 and 25, and is substantially perpendicular with respect to top and bottom walls 26 and 27, and because spots of adhesive 100 relate to LEDs, the length of light component assembly 41 extending between proximal end 60 to distal end 61 is substantially parallel with respect to sidewalls 24 and 25 of glass block 21, and is substantially perpendicular with respect to top and bottom walls 26 and 27. The length of light component assembly 41 from proximal end 60 to distal end 62 extends along exterior surface 22A of front wall 22 of glass block 21 between top and bottom walls 26 and 27, in which proximal end 60 is directed toward and is located just inboard of top wall 26, and distal end is directed toward and is located just inboard of bottom wall 27. In this orientation of light component assembly 41, power cord 75 project outwardly and away from top wall 26 of glass block 21. Having applied light component assembly 41 to exterior surface 22A of front wall 22 of glass block 21, shell 44 is then affixed in place to exterior surface 22A of front wall 22 of glass block 21 in the construction of light fixture assembly 22.

Figure 8:
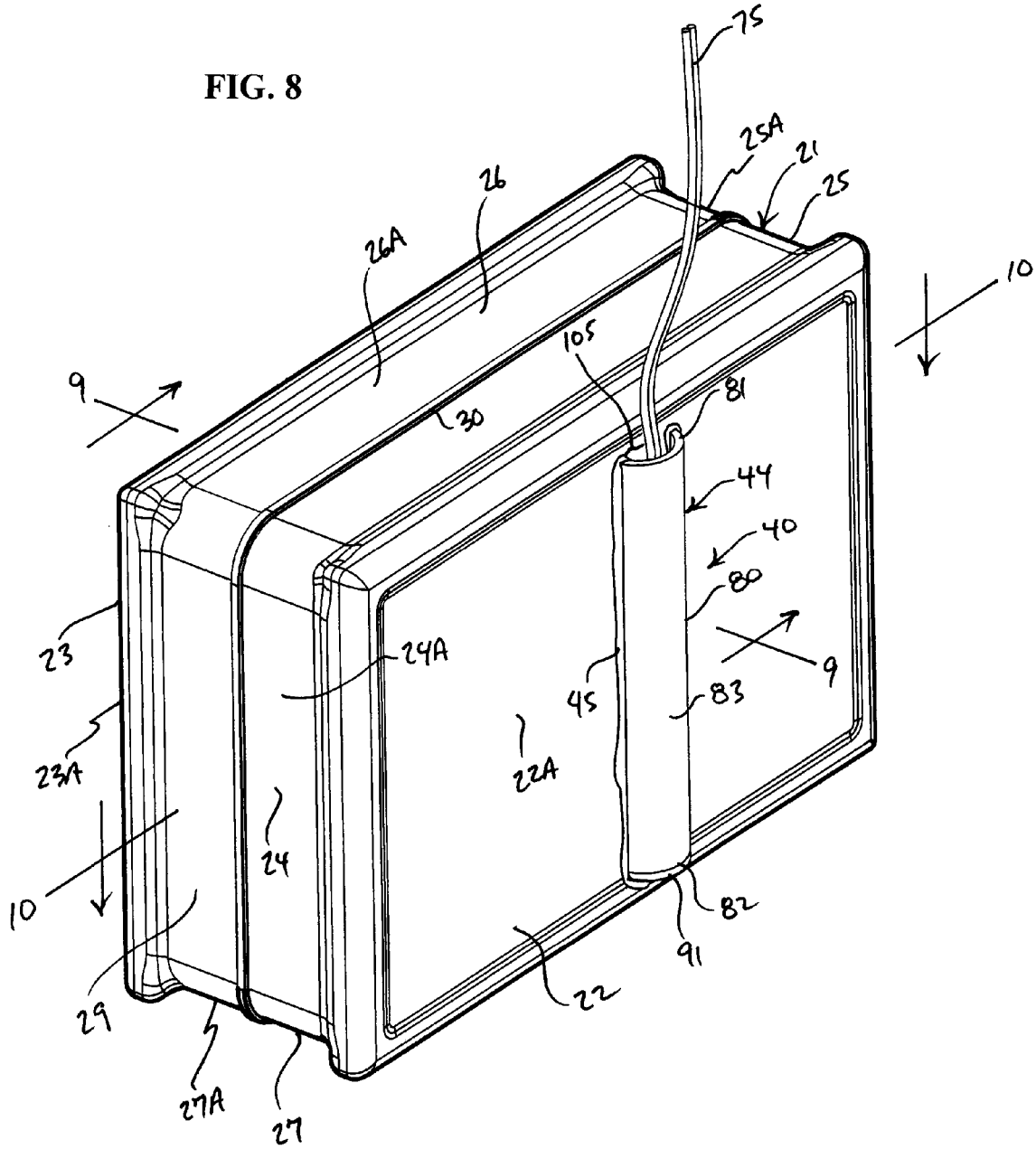
FIG. 8 is a perspective view of the shell of FIG. 4 adhered to a surface of the light-transmissive fixture with the band of adhesive.
Figure 10:
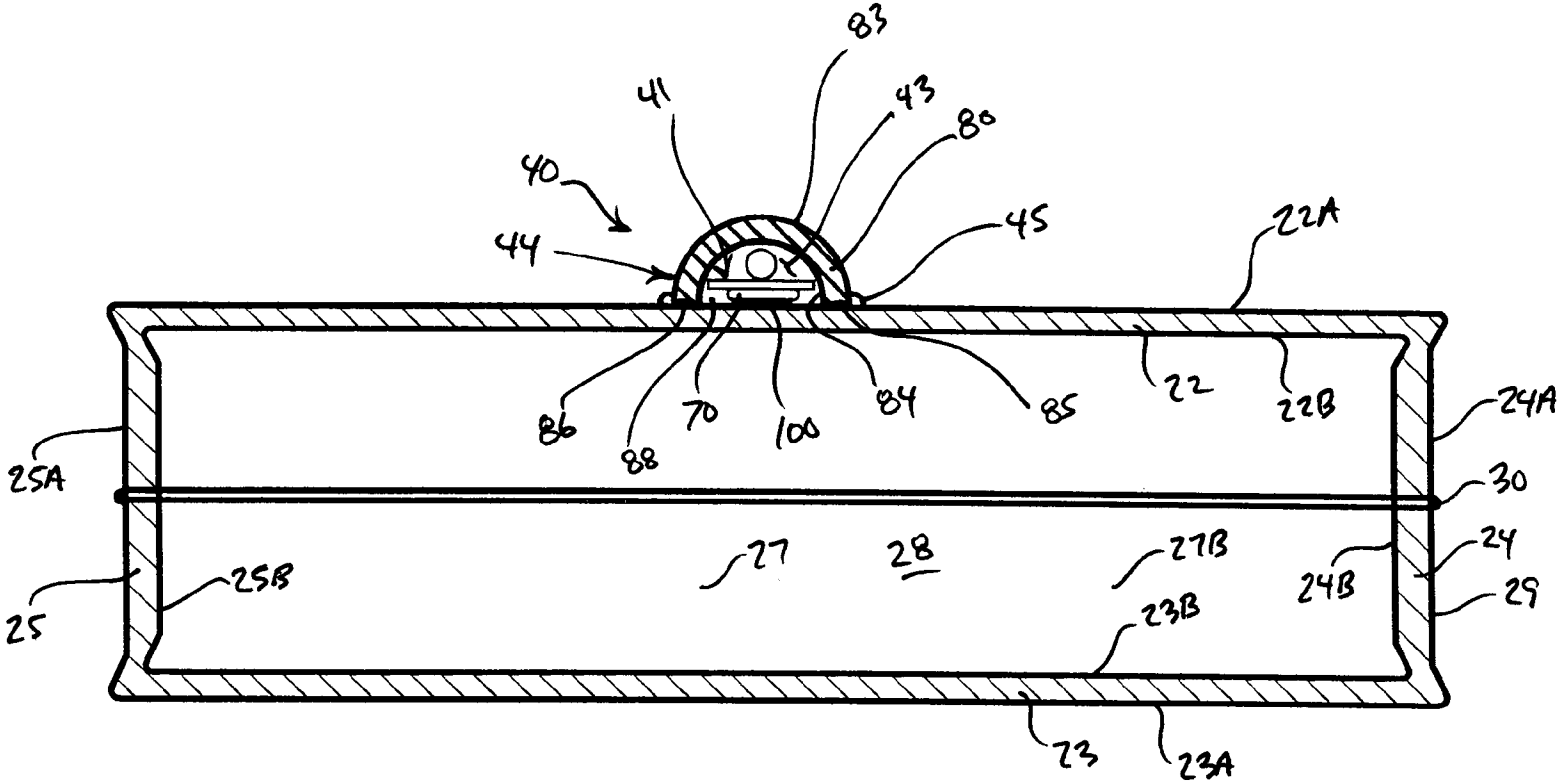
FIG. 10 is a section view taken along line 10-10 of FIG. 8 illustrating a volume formed between the shell and the surface of the light-transmissive fixture.

To install shell 44, a band of adhesive 45 is preferably applied along edges 85 and 86 of shell wall 80 of shell 44 and along lower edge 92 of cap 91 of shell 44. After band of adhesive 45 is so applied, shell 44 is taken up by hand and positioned opposite to light component assembly 41 applied to exterior surface 22A of front wall 22 of glass block 21 to substantially register the length of shell 44 from proximal end 81 to distal end 82 to the length of light component assembly 41 extending from proximal end 60 to distal end 61 to substantially register volume 43 of shell 44 with respect to light component assembly 41, to substantially register proximal end 81 of shell 44 with proximal end 60 of light component assembly 41, and to substantially register distal end 82 of shell 44 with distal end 61 of light component assembly 41. At this point, shell 44 is moved toward exterior surface 22A of front wall 22 of glass block 21 in the direction indicated by the arrowed line B in FIGS. 4 and 5, and is applied over light component assembly 41 directing light component assembly 41 into volume 43 through gap 88 locating edges 84 and 85 of shell 44 along either side of light component assembly 41 extending from proximal end 81 of shell 44 at proximal end 60 of light component assembly 41 to distal end 82 of shell 44 at distal end 61 of light component assembly 41, locating lower edge 92 of cap 91 of shell 44 along distal end 61 of light component assembly 41, and applying band of adhesive 45 against exterior surface 22A of front wall 22 of glass block 21 thereby applying band of adhesive 45 between exterior surface 22A of front wall of glass block 21 and edges 84, 85, and 92 of shell 44 as shown in FIGS. 8, 9, and 10. At this point, band of adhesive 45 is left to cure or harden during a waiting period sufficient to band of adhesive 45 to harden or cure to adhesively affix shell 44 to exterior surface 22A of front wall 22 of glass block 21. In a preferred embodiment, the adhesive forming band of adhesive 45 is preferably a tenacious, fast-acting adhesive, such as a cyanoacrylate-based fast-acting adhesive, that hardens or otherwise cures in a relatively short period of time, such as from about 30-60 seconds upon application. Other like or similar tenacious adhesives can be used without departing from the invention.

FIGS. 8, 9, and 10 show the installation of shell 44, in which shell 44 is applied over light component assembly 41 locating light component assembly 41 in volume 43. As explained above in connection with FIGS. 2 and 3, and which will now be discussed in detail in relevant part in reference to FIGS. 8, 9, and 10, edges 84 and 85 of shell 44 are applied against exterior surface 22A of front wall 22 of glass block 21 on, and extend along, either side of light component assembly 41 and extend along the length of light component assembly 41 along exterior surface 22A from proximal end 81 of shell 44 at proximal end 60 of light component assembly 41 to distal end 82 of shell 44 at distal end 61 of light component assembly 41. Lower edge 92 of cap 91 of shell 44 extends along exterior surface 22A of front wall 22 of glass block 21 along or otherwise across proximal end 61 of light component assembly 41, and volume 43 of shell 44 extends between proximal end 81 of shell 44 and distal end 82 of shell 44 and is defined between inner surface 84 of wall 80 of shell 44 and exterior surface 22A of front wall 22 of glass block 21. Light component assembly 41 extends into volume 43 through gap 88 formed between edges 84 and 85 of shell 44 affixed to exterior surface 22A of front wall 22 of glass block 21 with band of adhesive 45. Light component assembly 41 extends substantially centrally into and through volume 43 from proximal end 60 of light component assembly 41 located in volume 43 just inboard of proximal end 81 of shell 44, to distal end 61 directed toward cap 91 at distal end 82 of shell 44. Because the length of light component assembly 41 extending between proximal end 60 to distal end 61 is substantially parallel with respect to sidewalls 24 and 25, and is substantially perpendicular with respect to top and bottom walls 26 and 27, the length of shell 44 extending from proximal end 81 to distal end 82 is, in turn, substantially parallel with respect to sidewalls 24 and 25, and is substantially perpendicular with respect to top and bottom walls 26 and 27.

The length of shell 44 from proximal end 81 to distal end 82 extends along exterior surface 22A of front wall 22 of glass block 21 between top and bottom walls 26 and 27, in which proximal end 81 is directed toward and is located just inboard of top wall 26, and distal end 82 is directed toward and is located just inboard of bottom wall 27. Cap 91 applied to distal end 82 of shell 44 forms a closed end of volume 43 formed between exterior surface 22A of front wall 22 of glass block and inner surface of shell wall 80, and proximal end 81 of shell wall 80 is left open to define an open end 105 of shell 44 defining an opening between distal end 81 of shell 44 and exterior surface 22A of front wall 22 of glass block that leads to volume 43 defined between shell 44 and exterior surface 22A of front wall 22 of glass block 21.

Figure 11:
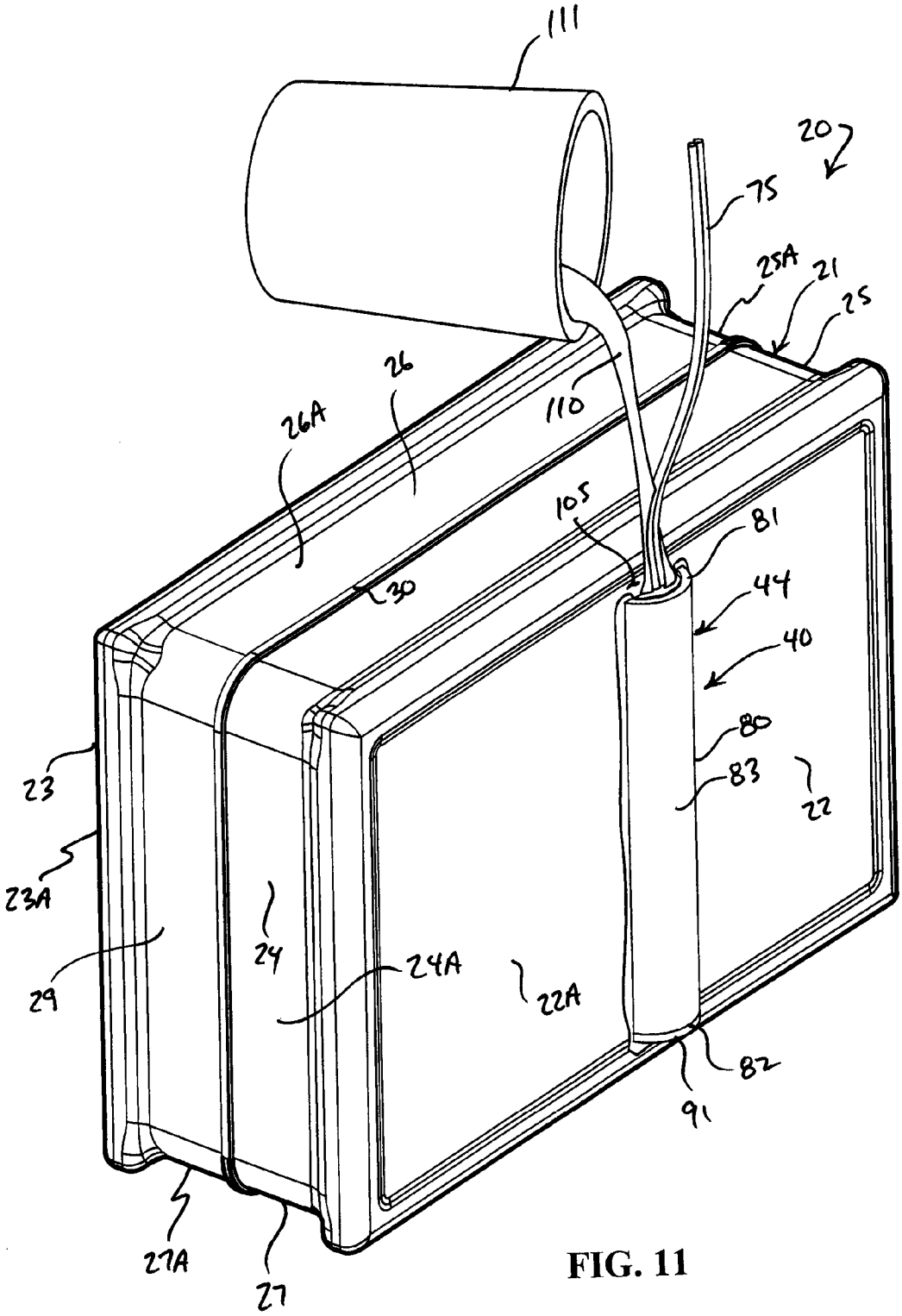
FIG. 11 is a perspective view similar to that of FIG. 8 illustrating a mass of hardenable material being poured into the volume formed between the shell and the surface of the light-transmissive fixture depicted in FIGS. 9 and 10.

Having so applied light component assembly 41 and shell 44 to exterior surface 22A of front wall 22 of glass block 21 as explained above in detail, mass of hardened material 42 is then formed in volume 43. This is carried out by providing a mass of hardenable material 110 as shown in FIG. 11, applying mass of hardenable material 110 to volume 43 to fill volume 43 with mass of hardenable material 110 to thus embed light component assembly 41 in mass of hardenable material 110, and then waiting for the mass of hardenable material 110 to cure or otherwise harden to form mass of hardened material denoted at 42 as shown in FIGS. 2 and 3 encapsulating light component assembly 41 embedded in mass of hardened material 42. Mass of hardenable material 110 is preferably uncured, liquid, which is applied to a container or receptacle 111. To fill volume 43, hardenable material 110 is poured from receptacle 111 into volume 43 through opening or open end 105 formed at proximal end 81 of shell 44 until volume 43 is filled from proximal end 81 of shell 44 to distal end 82 of shell 44. After hardenable material 110 is applied to volume 43 as described, hardenable material 110 is left to cure or harden during a waiting period sufficient to allow hardenable material 42 in volume 43 to harden or cure. The uncured epoxy that forms hardenable material 110 is a conventional thermosetting polymer that will cure or harden within approximately 4-6 hours after application to volume 43. Hardenable material 110 cures or hardens to form mass of hardened material 42 referenced in FIGS. 2 and 3, whereby light component assembly 41 secured to exterior surface 22A of front wall 22 of glass block 21 is embedded into other otherwise encapsulated by mass of hardened material 42 as explained above to isolate light component assembly 41 from environmental influences, and this completes the formation of light fixture assembly 20. Because hardenable material 110 is epoxy, it adheres to exterior surface 22A upon hardening or curing to form mass of hardened material 42. Before securing light component assembly 41 and shell 44 to exterior surface 22A of front wall 22 of glass block 21, exterior surface 22A of front wall 22 of glass block 21 may be roughened or scratched, such as with steel wool or sandpaper or through a chemical etching process or the like, to form roughened or scratched areas on exterior surface 22A denoted by broken lines 35 in FIG. 4 to improve adhesion between adhesive 100 to exterior surface 22A and to improve adhesion between mass of hardened material 42 to exterior surface 22A during the curing or hardening of mass of hardenable material 110. Also, exterior surface 22A may be thorough washed and dried before the installation of light assembly 40.

Application of light assembly 40 to glass block 21 forms light fixture assembly 20 as shown in FIG. 1, and light assembly 40, which is a LED assembly, applied to exterior surface 22A of glass block 21 operates to illuminate glass block 21 from exterior surface 22A of front wall 22 of glass block 21. Light fixture assembly 20 is exemplary of an illuminated glass block assembly, which can be installed at various selected locations as may be desired, whether at an indoor location or an outdoor location, to provide a pleasing illuminated light fixture. Because light fixture assembly 20 includes glass block 21, which is an architectural element, glass block 21 may be installed in a glass block labyrinth, such as the type used to obscure visual line of site into a washroom or other area, a glass block floor, or the like. In a particular embodiment as illustrated in FIG. 13, a plurality of light fixture assemblies 20 may be electrically connected to form a lighting system 120 consisting of a plurality of electrically-connected light fixture assemblies. In FIG. 13, the power cords 75 of the respective light fixture assemblies 20 are electrically connected in a conventional manner to a main power line 121 thereby electrically connecting the light fixture assemblies 20. Although lighting system 120 in FIG. 13 incorporates four light fixture assemblies 20, less or more can be provided in such a light system. As with one light fixture assembly 20, a lighting system incorporating a plurality of electrically connected light fixture assemblies, such as lighting system 120, can be incorporated into a glass block labyrinth, a glass block floor, or the like. Cords 75 are connected in multiple in parallel wiring fashion with main power line 121 preferably to a low-voltage electrical buss wire which carries low voltage to the individual power cords 75.

Figure 14:
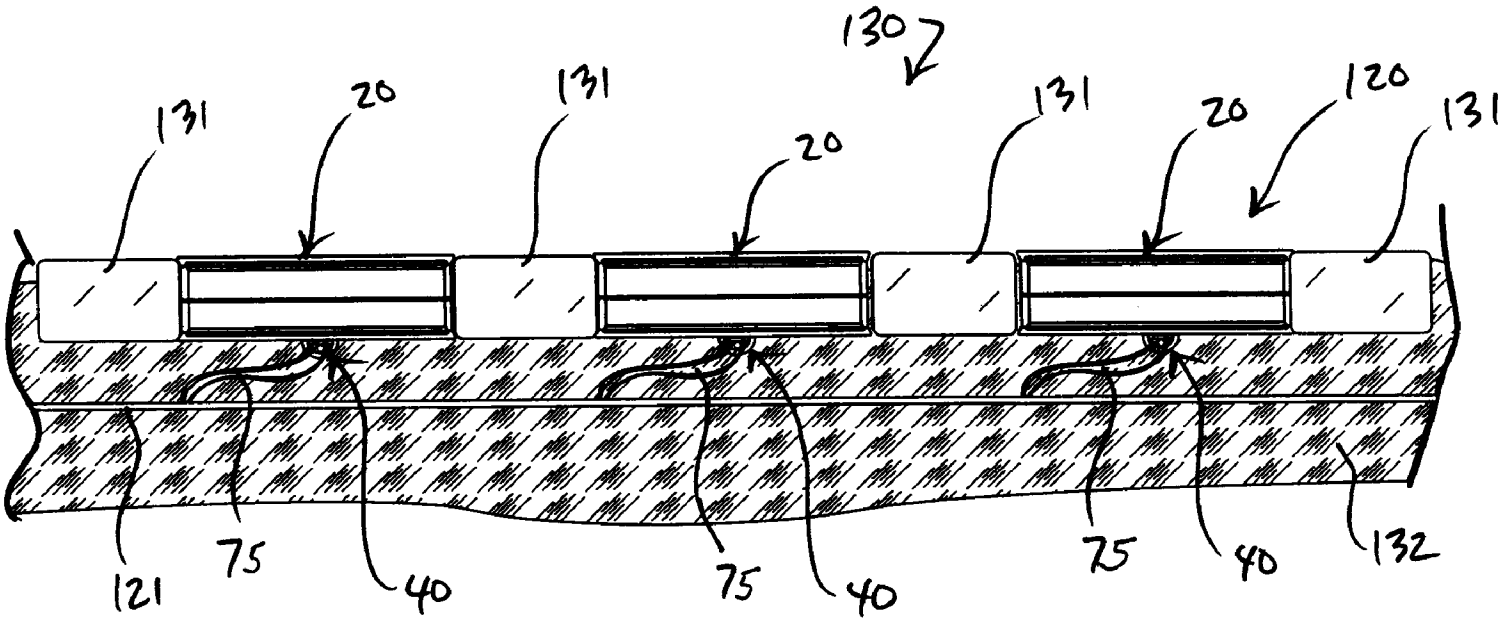
FIG. 14 is a highly generalized schematic representation of electrical wiring electrically coupling a plurality of light fixture assemblies each constructed and arranged in accordance with the principle of the invention and shown as they would appear installed forming a paver installation.

As a matter of example of a particular form of installation, FIG. 14 illustrates lighting system 120 of FIG. 13 shown as it would appear installed in a paver installation 130 consisting of a row of alternating tiles or bricks 131 and light fixture assemblies 20 of lighting system 120 installed into a prepared substrate 132 to form part of, for example, a floor, a walkway, a driveway, or perhaps a decorative border of a walkway or driveway. In FIG. 14, front walls 22 of light fixture assemblies 20 are positioned downwardly into substrate 132 directing light assemblies 40 into substrate 132, and power cords 75 and power line 121 are, in turn, buried in substrate 132. When light assemblies 40 of light fixture assemblies 20 illuminate to illuminate the respective glass blocks 21, glass blocks 21 each provide a pleasing illuminated component of paver installation 130.

As glass blocks 21 of light fixture assemblies 20 are architectural elements and are quite strong and rugged, glass blocks 21 can be walked over, and driven over by vehicles, lawnmowers, bicycles, and the like. Installation of light fixture assemblies 20 in a paver installation can be carried out simply by placing light fixture assemblies 20 onto substrate 132, and the installation of light fixture assemblies 20 in a paver installation, such as paver installation 130, requires no mounting hardware, fixtures, frames, or the like. A light assembly constructed and arranged in accordance with the principle of the invention can be similarly installed directly into poured concrete with no required hardware, fixtures, or frames. Moreover, because the light component assemblies 41 of the light assemblies 40 of the light fixture assemblies 20 are substantially isolated from environmental influences with the respective encasements as described, light fixture assemblies 20 are particularly suited for outdoor lighting installations as they are weatherproof and resistant to environmental influences.

Figure 15:
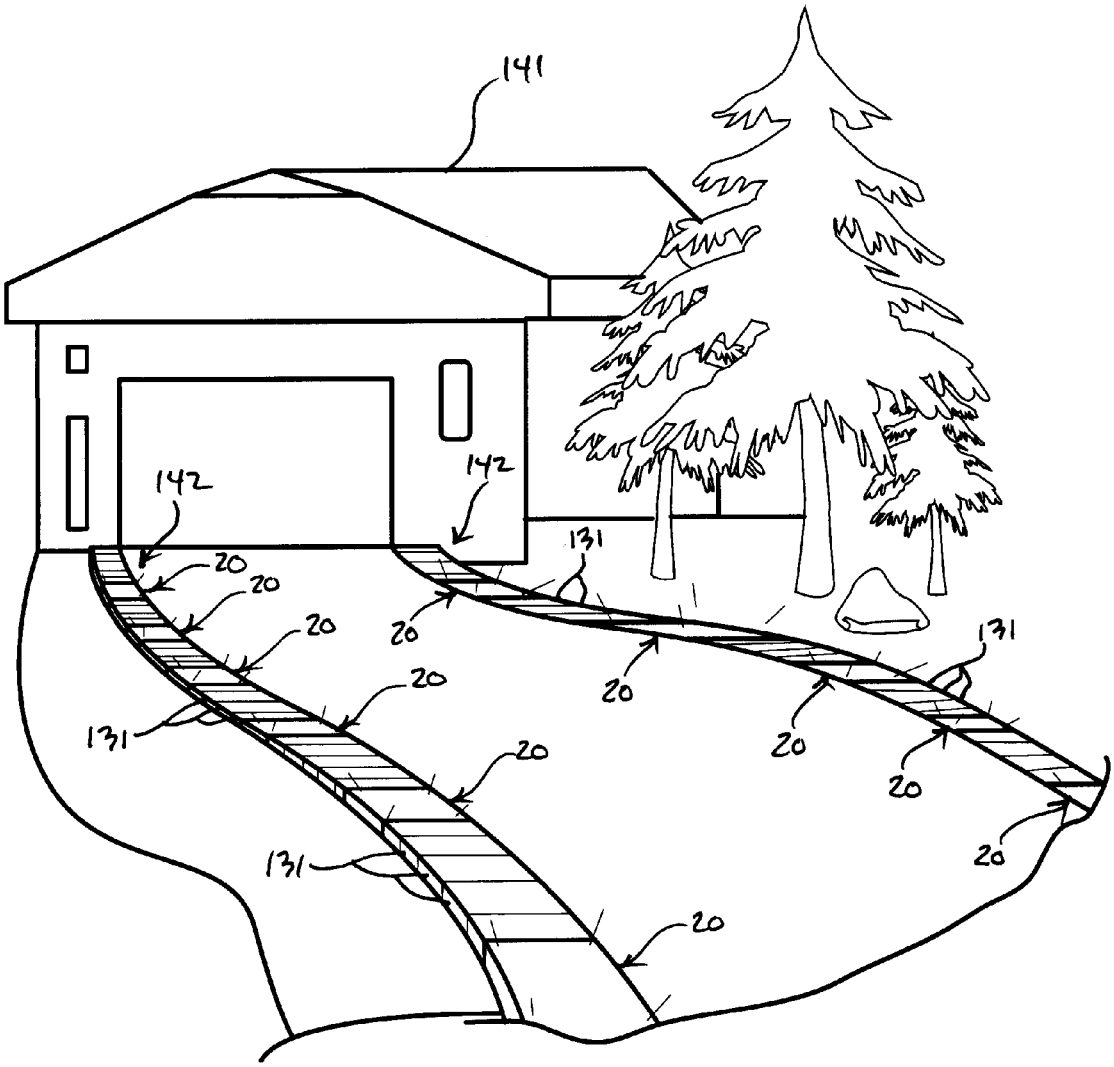
FIG. 15 is a highly generalized schematic representation of a plurality of light fixture assemblies each constructed and arranged in accordance with the principle of the invention and shown as they would appear installed in opposed paver installations formed on either side of a driveway leading to a dwelling.

As explained above, paver installation 130 can be formed at an interior location, or an exterior location. Although in paver installation the pattern of tiles or bricks 131 and light fixture assemblies 20 is a row of alternating tiles or bricks 131 and light fixture assemblies 20, other patterns can be implemented without departing from the invention. As a matter of illustration and reference, FIG. 15 illustrates a driveway 140 leading to a dwelling 141, with opposed paver installations 142 formed on either side of driveway 140. Paver installations 142 each incorporate a plurality of tiles or bricks 131 and plurality of light fixture assemblies 20 that provide paver installations 142 with illuminated features. Paver installations 142 are each structurally common to paver installation 130 with the exception that the pattern of tiles or bricks 131 and light fixture assemblies 20 is characterized by a plurality of tiles or bricks 131 formed between opposed pairs of light fixture assemblies 20. As paver installations 142 incorporating light fixture assemblies 20 are located at an outdoor location, paver installations 142 are exemplary of a form of landscaping incorporating light fixture assemblies 20. Those of ordinary skill in the art will readily appreciate that one or more light fixture assemblies 20 constructed and arranged in accordance with the principle of the invention can be formed in any desired landscape construction.

Light fixture assembly 20 consists of two main elements, namely, glass block 21 and light assembly affixed to an exterior surface of glass block 21, which, in the present embodiment, is exterior surface 22A of front wall 22 of glass block 21. As the attachment of light assembly 40 to glass block 21 requires no modification to glass block 21, light fixture assembly 20 is convenient and inexpensive to manufacture. Although light assembly is formed at exterior surface 22A of front wall 22 of glass block 21, light assembly 40 can be affixed to another exterior surface of glass block 21 if so desired, such as exterior surface 23A of glass block 21, an may be positioned or otherwise oriented in any selected direction or orientation with respect to the glass block. Although the light fixture assembly 20 set forth in this disclosure is fashioned with one light assembly 40 secured to glass block 21, more than one light assembly 40 may be secured at various locations to a glass block in a light fixture assembly constructed and arranged in accordance with the principle of the invention if so desired.

Figure 16:
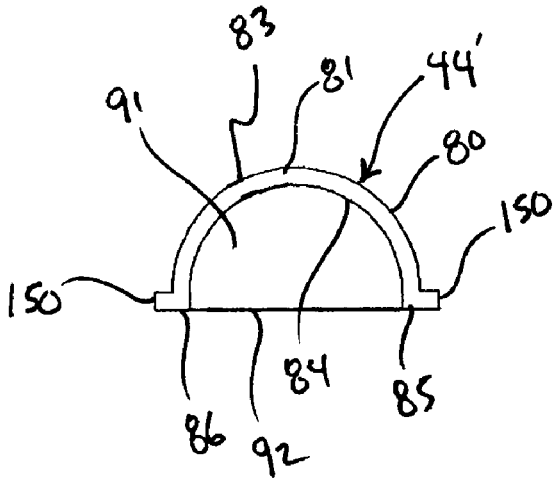
FIG. 16 is a front elevation view of an alternate embodiment of a shell for use in a light fixture assembly constructed and arranged in accordance with the principle of the invention.
Figure 17:
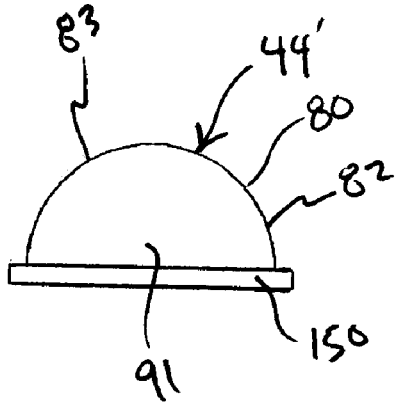
FIG. 17 is a rear elevation view of the shell of FIG. 16.

The invention has been described above with reference to a preferred embodiment. However, those skilled in the art will recognize that changes and modifications may be made to the embodiment without departing from the nature and scope of the invention. For instance, FIG. 16 is a front elevation view of an alternate embodiment of a shell 44' for use in a light fixture assembly constructed and arranged in accordance with the principle of the invention, and FIG. 17 is a rear elevation view of shell 44'. In common with shell 44, and referring to FIGS. 16 and 17 in relevant part, shell 44' shares shell wall 80 having proximal end 81, distal end 82, outer surface 83, inner surface 84, edges 85 and 86, cap 91, and edge 92 of cap 91. In shell 44', edges 85, 86, and 92 are formed with an outwardly projecting flange or foot 150, which provides a greater surface area for forming a more aggressive adhesive bond between shell 44' and the surface of a glass block in the construction of a light fixture assembly constructed and arranged in accordance with the principle of the invention.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A light fixture assembly, comprising:

a light-transmissive fixture, the light-transmissive fixture having an exterior surface;

a shell applied to the exterior surface;

a volume formed between the shell and the exterior surface of the light-transmissive fixture;

the volume filled with a mass of hardened material applied to the exterior surface of the light-transmissive fixture;

a light-emitting diode (LED) assembly comprised of light-emitting diodes (LEDs), the LEDs applied to the exterior surface of the light-transmissive fixture and being located in the volume and formed in the mass of hardened material, the mass of hardened material substantially isolating the LED assembly from environmental influences, and the LED assembly to illuminate the light-transmissive fixture; and the LEDS being affixed to the exterior surface of the light-transmissive fixture with adhesive applied between the exterior surface of the light-transmissive fixture and the LEDs, the adhesive being applied on the exterior surface of the light-transmissive fixture and on each of the LEDs so as to adhesively bond each of the LEDs to the exterior surface of the light-transmissive fixture.

2. A light fixture assembly according to claim 1, wherein the LED assembly is electrically connected to a power cord to transmit electrical power to the LED assembly.

3. A light fixture assembly according to claim 2, wherein the LEDs are mechanically carried by a circuit board assembly.

4. A light fixture assembly according to claim 3, wherein the circuit board assembly electrically connects the LEDs.

5. A light fixture assembly according to claim 4, wherein the circuit board assembly is located in the volume and embedded in the mass of hardened material, the mass of hardened material substantially isolating the circuit board assembly from environmental influences.

6. A light fixture assembly according to claim 5, wherein the mass of hardened material comprises a mass of hardened epoxy.

7. A light fixture assembly, comprising:

a glass block having an outer surface and an inner surface bounding an enclosed, interior volume;

a shell affixed to the outer surface of the glass block;

a volume formed between the shell and the outer surface of the glass block;

a mass of hardened material applied to the volume formed between the shell and the outer surface of the glass block, the mass of hardened material applied against and adhered to the outer surface of the glass block;

light-emitting diodes (LEDs) located in the volume, applied to the outer surface of the glass block, and embedded in the mass of hardened material, the mass of hardened material substantially isolating the LEDs from environmental influences, and the LEDs to illuminate the glass block; and the LEDS being affixed to the outer surface of the glass block with adhesive applied between the outer surface of the glass block and the LEDs, the adhesive being applied on the outer surface of the glass block and on each of the LEDs so as to adhesively bond each of the LEDs to the outer surface of the glass block.

8. A light fixture assembly according to claim 7, wherein the LEDs are electrically connected.

9. A light fixture assembly according to claim 8, wherein the LEDs are electrically connected with a circuit board assembly attached to the LEDs.

10. A light fixture assembly according to claim 9, wherein the circuit board assembly is electrically connected to a power cord to transmit electrical power to the LEDs.

11. A light fixture assembly according to claim 10, wherein the circuit board assembly is located in the volume and embedded in the mass of hardened material, the mass of hardened material substantially isolating the circuit board assembly from environmental influences.

12. A light fixture assembly according to claim 11, wherein the mass of hardened material comprises a mass of hardened epoxy.

* * * * *